United States Patent [19]

Berendsen

[11] Patent Number: 4,924,579

[45] Date of Patent: May 15, 1990

[54] LAYOUT SYSTEM FOR CONSTRUCTION FOUNDATION PLACEMENT

[76] Inventor: Carol Berendsen, 133 Dodge La., Sonoma, Calif. 95370

[21] Appl. No.: 198,770

[22] Filed: May 24, 1988

[51] Int. Cl.[5] ..... E04G 21/18

[52] U.S. Cl. ..... 33/1 LE; 33/404

[58] Field of Search ..... 33/405, 406, 404, 1 G, 33/1 H, 1 LE

[56] References Cited

U.S. PATENT DOCUMENTS

| | | | |
|---|---|---|---|
| 1,336,004 | 4/1920 | Victoria | 33/404 |
| 2,981,000 | 4/1961 | Long | 33/293 X |
| 3,250,009 | 5/1966 | Oseka | 33/404 |
| 3,318,004 | 5/1967 | Payne | 33/404 |
| 4,095,343 | 6/1978 | McPhail | 33/1 LE |

FOREIGN PATENT DOCUMENTS

| | | | |
|---|---|---|---|
| 151537 | 5/1953 | Australia | 33/404 |
| 700207 | 6/1951 | United Kingdom | 33/404 |

*Primary Examiner*—Harry N. Haroian

*Attorney, Agent, or Firm*—Bernhard Kreten

[57] ABSTRACT

A method and apparatus for laying out foundations prior to construction. Ideally, two stakes are provided for each corner to be formed in a construction project and line extends from each corner to an adjacent corner. Each stake is configured with a clamping mechanism which allows vertical and horizontal adjustment of the string associated therewith.

19 Claims, 2 Drawing Sheets

LAYOUT SYSTEM FOR CONSTRUCTION FOUNDATION PLACEMENT

FIELD OF THE INVENTION

The following invention relates generally to a method and apparatus for laying out foundations when constructing a building. Prior to pouring a foundation, walls defining the building must be located. A string is used to locate the outer surface of the prospective wall, and the string serves as a guide when placing a form used as a support when pouring the wall supports or footings.

BACKGROUND OF THE INVENTION

While many aspects of the construction industry have benefited by advancements in technology, the location of footings and the guides used to indicate where prospective walls are to be placed remains curiously primative. The common technique in laying out foundations involves the use of "batter boards".

Typically, to show the presence of a future wall, a piece of scrap lumber configured as a stake is driven in the ground at each end of the prospective wall and a string extends therebetween. The string is intended to be tangent to the outer surface of the wall to be constructed. A first problem arises in placement of the stakes because not all of the ground encountered is equally receptive for the placement of stakes therein. Thus, frequently the stake cannot be oriented coincident with the plane of the outer surface of the wall.

To overcome this, a board is frequently nailed to extend horizontally from one or more stakes which has been driven in the ground to offset the stake and provide alignment for a string and the future wall. First, it should be noted that placement of the horizontal board onto the stake by nailing is awkward without removal of the stake and using a surface for support when driving the nails. Second, such an arrangement suffers in accuracy because the resulting arrangement is unstable, particularly because the horizontal board may be installed as an after thought. Third, using this method, the system operates best when the stakes are driven in the ground vertically. Because the ground can be rocky in the area for placing stakes, the process can be a frustrating experience.

The evolution in the batter board system is perhaps best reflected in U.S. Pat. No. 4,080,739, to Ruhaak. It should be pointed out that all of the problems listed supra are present in this system, along with a few additional problems. Instead of needing a single spot where the ground in receptive to a stake, this system requires at least two such spots because the vertical posts describing this invention must be maintained perfectly vertical and parallel to one another.

SUMMARY OF THE INVENTION

Succinctly stated, the instant invention overcomes known prior art difficulties first by making it less important as to the exact placement of the stake, and second by improving the ability of the stake to penetrate the earth. More specifically, the stake according to the present invention is formed from metal having a pointed end which penetrates the earth more easily and includes means for facilitating extraction of the stake for subsequent reuse. More importantly however, the stake according to the present invention does not have to be perfectly placed vertically because the string attached to the stake can be adjusted easily through a mechanism supported on the stake which affords adjustment of the string both vertically and horizontally.

The ensuing description will use the terms "string" and "ray" interchangeably. This is because the key feature involves the projection of a line which abuts the outer surface of the wall to be built in tangential relationship, and many such mechanisms can generate this line. The essence of the invention facilitates the placement of this line by adjusting the line both vertically and horizontally as it extends from the stake. Thus, the horizontal and vertical adjustment mechanisms associated with the stake provide a plane from which the string, ray or line emanates such that the plane defined by the horizontal and vertical adjustments is perpendicular to the wall to be constructed.

Assume that a building is to be constructed which is substantially rectangular with respect to its external configuration. Such a building would have four walls and four corners. To efficiently lay out such a building using the system according to the present invention, eight stakes would be used in pairs having string attached to the pairs so that each string would parallel a wall. Four such strings would be used, and the intersection of any two strings would define a corner. Thus, two stakes are located at each corner.

Another feature attends the structure of the present invention. A clamp is used for fixing the string to the stake. This clamp has a width which is carefully selected to account for a practical consideration when forming a foundation. Typically, dimensioned lumber is used as a form defining an exterior boundary to contain concrete when pouring a foundation. The forming lumber is fixed in a vertical plane by driving stakes in the ground adjacent the lumber and outside the pour area to fix the forming lumber in a vertical plane. Since the width of the forming lumber is known, by providing a string clamp having the same width, two lines can extend from the pair of stakes defining the wall sucn that the space between the two lines defines the width of the form. This assures that the form will be vertical because it is sandwiched between the two lines, and the outermost line serves a guide for form supports (commonly configured as stakes).

OBJECTS OF THE INVENTION

Accordingly, it is a primary object of the present invention to provide a new and useful layout system for locating and forming foundations and walls of a building in construction.

A further object of the present invention is to provide a device as characterized above which includes a stake that supports a string through instrumentalities which alter the horizontal and vertical placement of the string, thereby rendering less important the exact placement of the stake in the ground.

A further object of the present invention contemplates providing a device as characterized above which is relatively inexpensive to manufacture and lends itself to mass production techniques.

A further object of the present invention includes providing a device as characterized above which markedly reduces the amount of time required in setting up foundation and wall boundaries.

It is a further object of the present invention to provide a device as characterized above which serves as a guide when assembling the forming which defines an exterior constraint when pouring the concrete footing.

Viewed from one vantage point, it is an object of the present invention to provide a layout system for defining wall boundaries when constructing a building, which includes a single stake placed in the ground along the general line of a wall to be built, a ray extending from the stake defining a line which is tangential to an outer surface of the wall to be built, and an instrumentality to adjust vertical elevation of the ray with respect to the stake and an instrumentality to laterally offset the ray with respect to the stake whereby the ray serves as a guide for building the wall.

Viewed from a second vantage point, it is an object of the present invention to provide a device as characterized above in which a layout system defines the placement of two walls when forming a corner when constructing a building in which two stakes are independently placed such that each stake is generally adjacent an extension of the plane defining its wall so that when built, the two walls form a corner, and includes a ray extending from each stake defining a line which is tangential to an outer surface of the wall to be built, and an instrumentality to adjust vertical elevation of each ray with respect to its stake, and an intrumentality to laterally offset each ray relative to its stake whereby the rays serve as guides for building the walls to form the corner.

Viewed from yet a further vantage point, a primary object of the present invention is to provide a method for building a wall which includes the steps of placing two stakes in the ground, running an initial line between the stakes which is to correspond to an outer limit of an exterior surface of the wall to be built, placing a form adjacent the line to form an outer barrier when pouring a wall footing, straddling the form with a second line spaced such that the form and form supports are interposed between the two lines, installing form supports, dropping the lines, and pouring the footing while leaving the stakes in place for subsequent use.

These and other objects will be made manifest when considering the following detailed specification when taken in conjunction with the appended drawing figures.

BRIEF DESCRIPTION OF THE DRAWING FIGURES

Figures 1, 3:
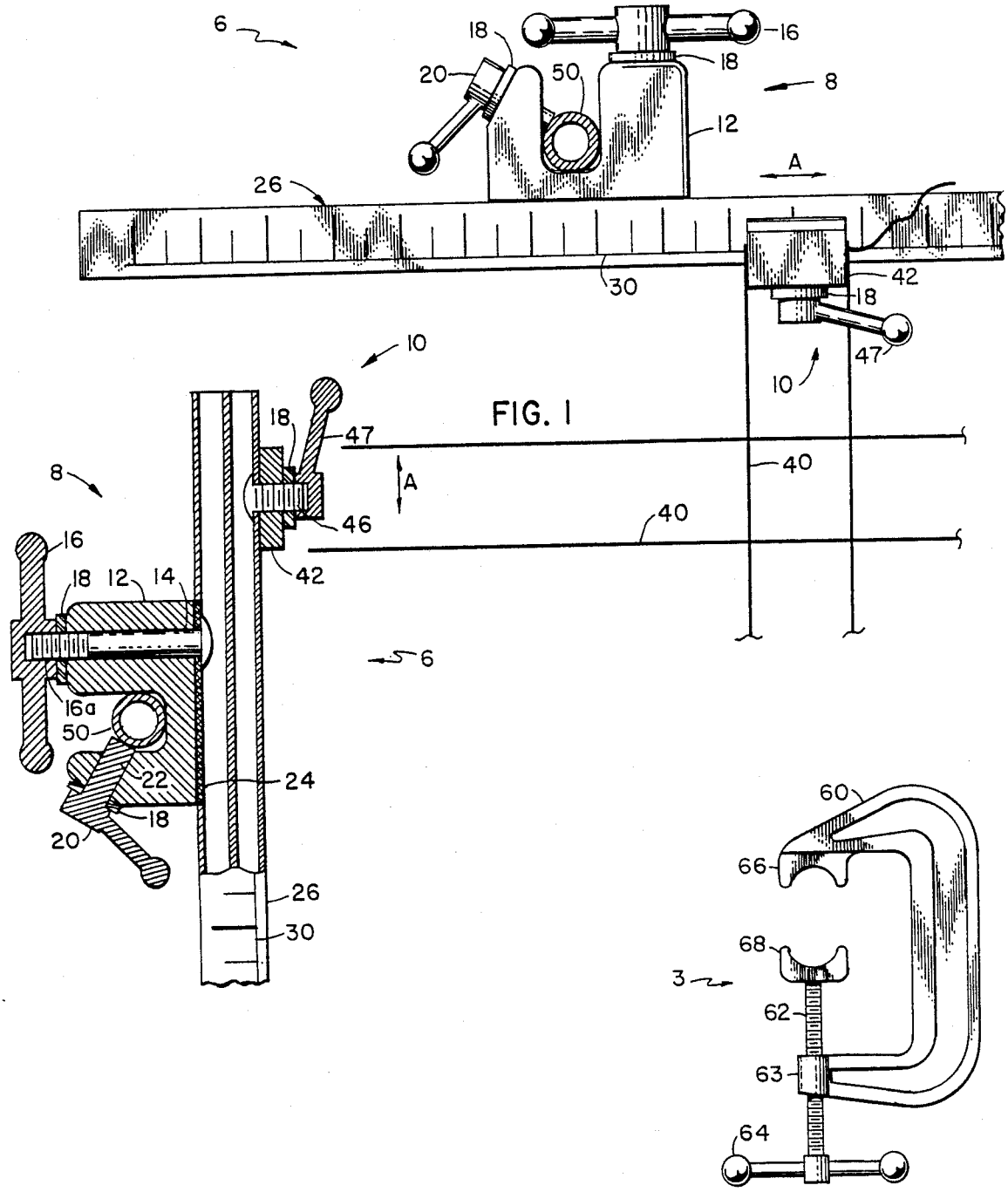
FIG. 1 is a top plan view, partially in section showing the layout system according to the present invention forming a corner.

FIG. 3 details a top plan view of a clamp according to the present invention.

BRIEF DESCRIPTION OF THE PREFERRED EMBODIMENT

Referring to the drawings now, wherein like reference numerals refer to like parts throughout the various drawing figures, reference numeral 6 is directed to the layout system according to the present invention.

In its essence, the layout system 6 includes a stake 50, a string 40, a string cleat 10 supported on a track 26 which in turn is retained on the stake 50 by a track retainer 8.

Figure 2:
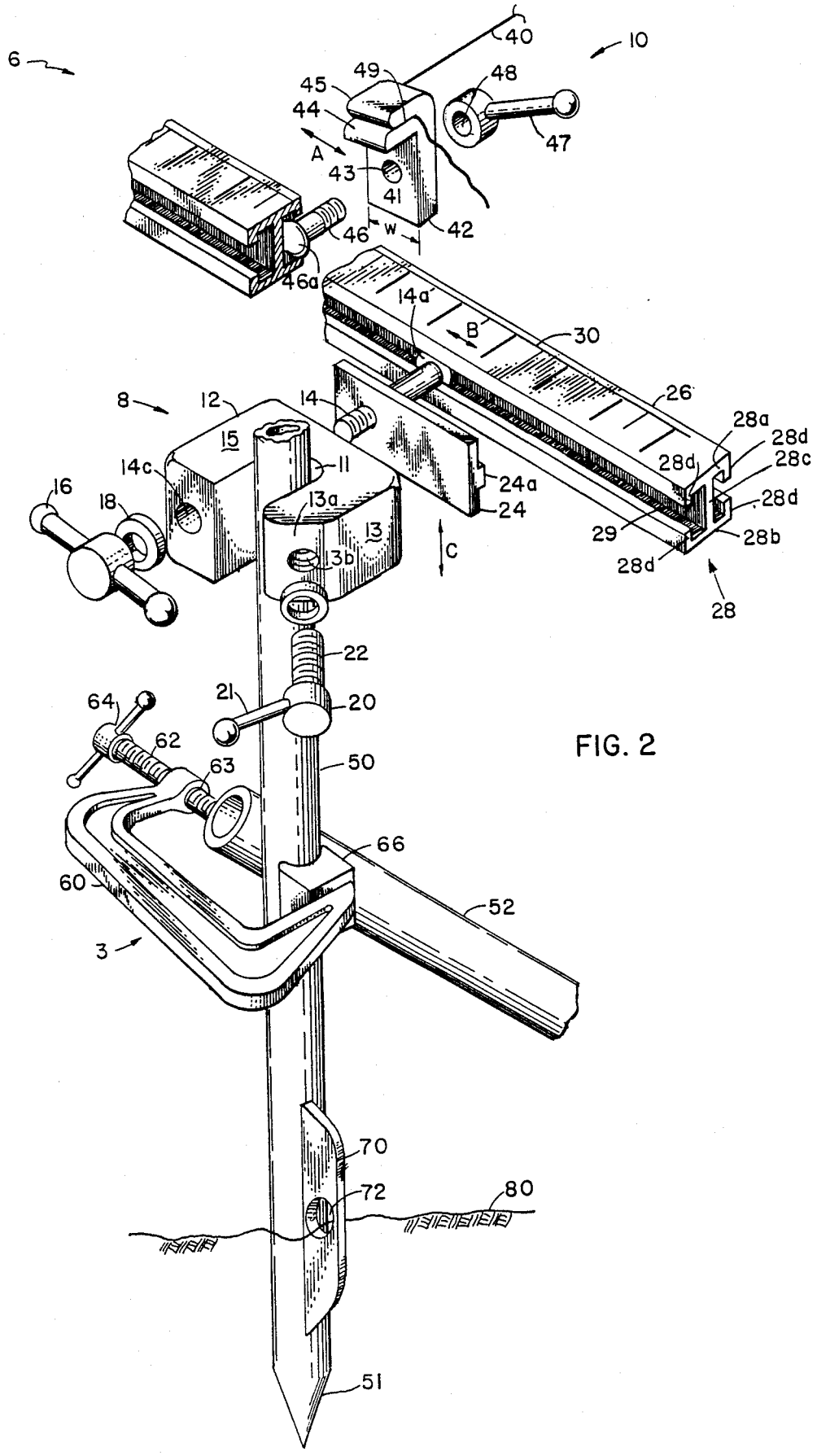
FIG. 2 is an exploded parts perspective view of the components defining one string support assembly according to the present invention.

As shown in FIG. 2 for example, the stake 50 has a pointed end 51 to facilitate penetration into the ground 80. In addition, a wing 70 extends radially from one side of the stake 50 so that when placed in the ground, the wing 70 resists rotation of the stake. In addition, the wing 70 has a hole 72 passing therethrough to facilitate removal of the stake 50 from the ground 80. By placement of a lever (not shown) through the hole 72, the stake 50 can be easily removed.

An upper portion of FIG. 2 reflects details with respect to the track retainer 8. More particularly, the retainer 8 includes a "U" shaped body 12 having a bight portion 11 which straddles the stake 50. The body 12 includes one relatively short leg 13 provided with a beveled face **13*a* and a bore 13*b* passing through the beveled face. The bore 13*b* is threaded and is aligned with a radius of the stake 50 so that a bolt 22 having threads complimental to the pitch of the threads of the bore 13*b* allows the track retainer 8 to be fixed on the stake 50 at any desired vertical elevation. The stake bolt 22 includes a bolt head 20 and a bolt crank arm 21 to facilitate wedging the retainer body 12 on the stake 50**. The double ended arrow "C" shows the direction of adjustment up or down the stake provided by this arrangement.

The longer leg 15 of the "U" shaped body 12 includes a centrally disposed bore **14*c* oriented in a substantially horizontal plane, and a threaded bolt 14 having a bolt head 14*a* passes therethrough. A free end of the threaded bolt 14 communicates with a vise crank 16 having a central threaded bore 16*a* which receives the threaded end 14 to tighten the bolt within the bore 14*c*. A washer 18 is interposed between the body 12 and the vise crank 16. The bolt head 14*a* retains a track 26 in fixed relationship with respect to the track retainer 8**.

As shown in FIG. 2, the track 26 is formed as a pair of face to face "E" shaped channel ways having a top wall **28*a*, a bottom wall 28*b*, a central web 28*c* extending between the top wall and the bottom wall, and four inwardly directed legs so as to define the face to face "E" shaped structure. As shown, the bolt head 14*a* passes through the track retainer 8 and has a track wear plate 24 interposed therebetween. The wear plate 24 includes a guide 24*a* having a configuration complimental to the gap 29 that exists between two of the inwardly directed legs 28*d* adjacent the "U" shaped body 12. Thus, loosening the vise crank 16 allows translation of the track 26** along the direction of the arrow "B".

An opposed face of the track 26, remote from the track retainer 8 supports a string cleat 10 as shown in FIG. 2. More particularly, the cleat 10 includes a bracket 42 having a vertical leg 41, a bore 43 passing therethrough, and a first horizontal leg 44. In addition, a second horizontal leg 45 is superposed above the first horizontal leg so that a slit 49 is provided between the two legs. Thus, a string 40 can be threaded through the slit 49 and can be frictionally retained therein. The string cleat is fastened to the track 26 as follows.

A bolt 46 having a head **46*a* retains the cleat and allows the cleat to move along the track along the direction of the arrow "A". The threaded shaft of bolt 46 cooperates with the threads contained within a bore 48 on a crank 47 for fixing the string cleat in one position on the track 26. In a preferred form of the invention, the cleat 10 has a width "W" which corresponds to the overall width of a form used as a side wall when pouring a foundation. The purpose of this arrangement is two fold. When the initial line is extended between two cleats which correspond to the outer most extent of a wall to be built, stringing the second line allows alignment of the stakes which support the form used to provide a barrier when pouring the concrete. The form having a nominal 2 inch thickness is supported on a side remote from the foundation wall by means of stakes. The thickness of the form is the width "W" of the cleat 10**. Thus, the initial truing allows the wall to be accurately placed, the use of the second string allows the form stakes to be accurately placed. Subsequently, the line can be used when actually constructing the wall.

With respect to FIGS. 2 and 3, details of the a C clamp 60 can now be explored. As shown, a C clamp 60 includes a threaded rod 62 which is captured within a threaded bore 63 on one leg of the C clamp. A free end of the threaded rod 62 includes a crank 64 for advancing the threaded rod 62 within the bore 63. A pair of arcuate jaws 66 and 68 are placed one on the C clamp and another at a facing end of the threaded rod 62. The arcuate jaws lend themselves to firmly grasping another cylindrical rod 52, commonly referred to as a "kicker". This rod 52 facilitates stability of the stake 50 so that tugs on the line 40 will be opposed and resisted by the kicker 52.

FIG. 1 shows an arrangement where two layout systems 6 are utilized to fashion a corner under construction. As can be shown, a pair of lines 40 intersect at 90 degrees which reflect the actual corner to be constructed. Thus, each corner will use two such layout systems, and a rectangular building would have a total of eight layout devices, two per corner. It can also be readily seen that by vertical adjustment of the track retainer 8 along the length of the rod 50, vertical adjustment is possible for a large number of gradations, and because of the construction of the track 26, horizontal adjustment can also be effected. To facilitate measurement, a top wall 28*a* of each track 26 is provided with indicia 30 on a top surface thereof for purposes of calibration if it should be necessary.

Moreover, having thus described the invention, it should be apparent that numerous structural modifications and adaptations may be resorted to without departing from the scope and fair meaning of the instant invention as discussed hereinabove and as set forth hereinbelow in the claims.

I claim:

1. A layout system for defining wall boundaries when constructing a building, comprising in combination:

a single stake placed in the ground along the general line of a wall to be built, a ray extending from said stake defining a line which is tangential to an outer surface of the wall to be built, means to adjust vertical elevation of said ray with respect to said stake, including a "U" shaped body having a bight portion interposed between a pair of legs which straddle said stake, and a threaded fastener passing through one said leg and frictionally retained against said stake, and means to laterally offset said ray with respect to said stake, wherein said means to laterally offset said ray with respect to said stake include a bore passing through another of said "U" shaped body's legs, a bolt extending therethrough having an end constrained to ride within a track, fastening means associated with a free end of said bolt as it exits said body leg, whereby said track can move with respect to said bolt whereby said ray serves as a guide for building the wall.

2. The system of claim 1 wherein a wear plate is interposed between said track and said "U" shaped body, said wear plate including a guide extending within a channel of said track to constrain said track along the length of said wear plate guide.

3. The system of claim 2 including a cleat constrained to ride on said track on a face thereof opposed from said "U" shaped body and means for fixidly retaining said cleat against said track.

4. The system of claim 3 wherein said cleat is formed as an inverted "L" shaped member having a vertical leg and a pair of horizontal legs, one stacked above the other and separated by a slit within which said ray is constrained, said ray configured as a string.

5. The device of claim 4 wherein said stake includes a wing at a lower most portion thereof provided with a hole whereby said wing retards rotation of said stake and said hole facilitates removal of said stake from the ground by placing a lever in said hole and forcing said stake out of the ground.

6. The system of claim 5 wherein a clamp is provided of substantially "C" shaped configuration having opposed arcuate jaws one of which is axially moveable by being fixed to a threaded rod, a crank attached to said threaded rod at an extremity remote from said threaded rod's arcuate jaw, and a rod constrained by said clamp and to said stake whereby said rod serves as a brace extending down towards the ground.

7. A layout system for defining two walls when forming a corner for constructing a building, comprising in combination:

two stakes independently placed such that each stake is generally adjacent an extension of the plane defining its wall, so that when built the two walls form a corner, a ray extending from each said stake defining a line which is tangential to an outer surface of the wall to the built, means to adjust the vertical elevation of each said ray with respect to its said stake, wherein said vertical adjusting means includes a "U" shaped body having a bight portion interposed between a pair of legs which straddle said stake, and a threaded fastener passing through one said leg and frictionally retained against said stake, and means to laterally offset each said ray relative to its said stake, wherein said means to laterally offset said ray with respect to said stake include a bore passing through another of said "U" shaped body's legs, a bolt extending therethrough having an end constrained to ride within a track, fastening means associated with a free end of said bolt as it exits said body leg, whereby said track can move with respect to said bolt whereby said rays serve as guides for building the walls to form the corner.

8. The system of claim 7 wherein a wear plate is interposed between said track and said "U" shaped body, said wear plate including a guide extending within a channel of said track to constrain said track along the length of said wear plate guide.

9. The system of claim 8 including a cleat constrained to ride on said track on a face thereof opposed from said "U" shaped body and means for fixidly retaining said cleat against said track.

10. The system of claim 9 wherein said cleat is formed as an inverted "L" shaped member having a vertical leg and a pair of horizontal legs, one stacked above the other and separated by a slit within which said ray is constrained, said ray configured as a string.

11. The device of claim 10 wherein said stake includes a wing at a lower most portion thereof provided with a hole whereby said wing retards rotation of said stake and said hole facilitates removal of said stake from the ground by placing a lever in said hole and forcing said stake out of the ground.

12. The system of claim 12 wherein a clamp is provided of substantially "C" shaped configuration having opposed arcuate jaws one of which is axially moveable by being fixed to a threaded rod, a crank attached to said threaded rod at an extremity remote from said threaded rod's arcuate jaw, and a rod constrained by said clamp and to said stake whereby said rod serves as a brace extending down towards the ground.

13. A layout system for defining wall boundaries when constructing a building, comprising in combination:

a single stake placed in the ground along the general line of a wall to be built, a ray extending from said stake defining a line which is tangential to an outer surface of the wall to be built, means to adjust vertical elevation of said ray with respect to said stake, and means to laterally offset said ray with respect to stake, whereby said ray serves as guide for building the wall, wherein said means to laterally offset said ray with respect to said stake includes "U" shaped body which has a bight portion and a pair of legs which straddle said stake, a bore passing through one of said "U" shaped body's legs, a bolt extending therethrough having an end constrained to ride within a track, fastening means associated with a free end of said bolt as it exits said body leg, whereby said track can move with respect to said bolt.

14. The system of claim 13 wherein said vertical adjusting means includes a threaded fastener passing through the other said leg of said "U" shaped body to retain said "U" shaped body against stake.

15. The system of claim 14 wherein a wear plate is interposed between said track and said "U" shaped body, said wear plate including a guide extending within a channel of said track to constrain said track along the length of said wear plate guide.

16. The system of claim 15 including a cleat constrained to ride on said track on a face thereof opposed from said "U" shaped body and means for fixedly retaining said cleat against said track.

17. The system of claim 16 wherein said cleat is formed as an inverted "L" shaped member having a vertical leg and a pair of horizontal legs, one stacked above the other and separated by a slit within which said ray is constrained, said ray configured as a string.

18. The system of claim 17 wherein said stake includes a wing at a lower most portion thereof provided with a hole whereby said wing retards rotation of said stake and said hole facilitates removal of said stake from the ground by placing a lever in said hole and forcing said stake out of the ground.

19. The system of claim 18 wherein a clamp is provided of substantially "C" shaped configuration having opposed arcuate jaws one of which is axially moveable by being fixed to a threaded rod, a crank attached to said threaded rod at an extremity remote from said threaded rod's arcuate jaw, and a rod constrained by said clamp and to said stake whereby said rod serves as a brace extending down towards the ground.

* * * * *